US006623206B1

(12) United States Patent
Blair et al.

(10) Patent No.: US 6,623,206 B1
(45) Date of Patent: Sep. 23, 2003

(54) PORTABLE SPEED BUMP

(75) Inventors: William H. Blair, Wheeling, WV (US); David R. Blair, Triadelphia, WV (US); Robert E. Steele, Wheeling, WV (US)

(73) Assignee: PMG, Inc., Wheeling, WV (US)

( * ) Notice: Subject to any disclaimer, the term of this patent is extended or adjusted under 35 U.S.C. 154(b) by 0 days.

(21) Appl. No.: 09/545,017

(22) Filed: Apr. 7, 2000

Related U.S. Application Data

(60) Provisional application No. 60/128,068, filed on Apr. 7, 1999.

(51) Int. Cl.[7] ..... E01F 9/047; E01F 9/04

(52) U.S. Cl. ..... 404/16; 404/15; 404/12

(58) Field of Search ..... 404/11, 12, 13, 404/14, 15, 16, 18, 10, 9, 6; 359/531, 547, 551

(56) References Cited

U.S. PATENT DOCUMENTS

| | | | | | |
|---|---|---|---|---|---|
| 3,798,743 | A | * | 3/1974 | Griswold | 404/15 |
| 4,012,156 | A | | 3/1977 | Turner et al. | 404/15 |
| 4,342,525 | A | | 8/1982 | Mastronuzzi, Jr. | 404/6 |
| 4,358,217 | A | * | 11/1982 | Stone | 404/16 |
| 4,362,424 | A | | 12/1982 | Barber | 404/6 |
| 4,697,294 | A | | 10/1987 | Schafer | 14/69.5 |
| 4,969,713 | A | * | 11/1990 | Wyckoff | 404/14 |
| 4,974,991 | A | | 12/1990 | Mandavi | 404/6 |
| 5,059,060 | A | | 10/1991 | Steinhardt | 404/11 |
| D336,524 | S | | 6/1993 | White et al. | D25/102 |
| 5,267,808 | A | | 12/1993 | Welford | 404/11 |
| 5,295,759 | A | | 3/1994 | Flanders et al. | 404/15 |
| D348,230 | S | | 6/1994 | Shairba | D10/113 |
| 5,354,143 | A | * | 10/1994 | Lindner | 404/13 |
| 5,393,166 | A | * | 2/1995 | Stock et al. | 404/14 |
| 5,507,588 | A | | 4/1996 | Marts et al. | 404/6 |
| 5,509,753 | A | | 4/1996 | Thompson | 404/6 |
| 5,513,924 | A | * | 5/1996 | Alghunaim | 404/14 |
| 5,630,674 | A | * | 5/1997 | Inaba | 404/15 |
| 5,639,179 | A | * | 6/1997 | Jensen | 404/16 |
| 5,667,335 | A | * | 9/1997 | Khieu et al. | 404/14 |
| D387,181 | S | | 12/1997 | Sinclair | D25/102 |
| 5,703,719 | A | * | 12/1997 | Chen | 404/16 |
| 5,710,558 | A | * | 1/1998 | Gibson | 404/11 |
| 5,769,563 | A | * | 6/1998 | Flynn | 404/15 |
| 5,775,834 | A | * | 7/1998 | Jackson | 404/15 |
| 5,975,794 | A | * | 11/1999 | Hedgewick | 404/14 |
| 6,010,277 | A | * | 1/2000 | Follman | 404/11 |
| 6,032,684 | A | * | 3/2000 | Narron | 135/90 |
| 6,079,899 | A | * | 6/2000 | Green | 404/12 |
| 6,102,612 | A | * | 8/2000 | Pricone et al. | 404/13 |
| 6,116,812 | A | * | 9/2000 | Hedgewick | 404/14 |
| 6,126,360 | A | * | 10/2000 | May et al. | 404/14 |
| 6,168,276 | B1 | * | 1/2001 | Weid | 404/12 |
| 6,174,103 | B1 | * | 1/2001 | Stroman | 404/15 |

FOREIGN PATENT DOCUMENTS

| | | | | | |
|---|---|---|---|---|---|
| DE | 3243842 | A1 | * | 5/1984 | E01F/9/00 |
| FR | 2596081 | A1 | * | 3/1986 | E01F/11/00 |
| GB | 2030197 | A | * | 4/1979 | E01F/13/00 |
| GB | 2175335 | A | * | 5/1985 | E01F/13/00 |
| WO | WO-91/19856 | | * | 12/1991 | E01F/9/04 |

* cited by examiner

*Primary Examiner*—Robert E. Pezzuto
*Assistant Examiner*—Alexandra K. Pechhold
(74) *Attorney, Agent, or Firm*—Steptoe & Johnson PLLC

(57) ABSTRACT

A portable speed bump unit having a plurality of speed bump cells removably and pivotally connected together to form a single PSB unit of variable length. Each speed bump cell comprises a plastic base having a rectangular footprint, a raised top surface, and a cross-sectional profile that is generally trapezoidal or semi-circular in shape. The speed bump cells are interconnected via one or more hinge bars that are pivotally connected together, thereby allowing two adjacent speed bump cells to be folded together such that an entire PSB unit can be rolled up for easy retrieval, portability, and storage purposes and simply unrolled to an extended position for deployment and use. Alternative embodiments of a portable speed bump unit incorporate safety features, e.g., reflective materials and/or lights, into one or more portable speed bump cells, or a controller into one or more portable speed bump cells for controlling a means for counting vehicles, a means for activating an alarm, or a means for heating the portable speed bump cells.

31 Claims, 7 Drawing Sheets

PORTABLE SPEED BUMP

CROSS REFERENCE TO RELATED APPLICATION

This application claims the benefit of application Ser. No. 60/128,068, filed Apr. 7, 1999.

BACKGROUND OF THE INVENTION

1. Field of the Invention

This invention relates to apparatuses used to control the speed of vehicles, and specifically, to a portable speed bump for causing a vehicle to slow its speed as it traverses over the portable speed bump.

2. Related Art

Speed bumps are extensively used as an effective means for controlling the speed of a vehicle. They are typically used in those high traffic and/or high populated areas that require slower speeds, e.g., school zones, parking lots, construction zones, tollways, and entrance and exit ramps.

The most common speed bump is a permanent structure integrated with a road surface such as an elongated rubber, asphalt, concrete, or steel bars having a rounded top surface. As a vehicle approaches the speed bump, the driver must slow to an appropriate speed in order to prevent severe vibration or jolting of the vehicle when passing over the speed bump. The principal disadvantage with conventional speed bumps is that they are permanent structures which are not intended to be moved. If a new situation should arise wherein a speed bump is needed quickly, it would be impossible for a conventional speed bump to be installed due to the time and materials needed to install such a speed bump. Therefore, there is a need for a portable speed bump that can be deployed and retracted as needed and by a single person.

As a possible answer to the need for a portable speed bump, several speed bumps have been created that purport to being portable. However, these conventional "portable" speed bumps also have disadvantages associated with them that rendered them impractical to use. In U.S. Pat. No. 4,697,294 to Schafer (the "Schafer Patent"), a modular speed bump is disclosed comprising a plurality of ramp plates fixable to a highway surface. Although the Schafer Patent suggests that the modular speed bump is removable from the highway surface, it requires extra equipment and time to install and remove a plurality of bolts. Therefore, the modular speed bump is not truly portable and is not easily deployed and retracted. Furthermore, the modular speed bump can not be stored and transported as an assembled structure, but rather, must be stored and transported in modular pieces which makes it cumbersome to use.

In U.S. Pat. No. DES 348,230 to Shairba (the "Shairba Patent "), a portable speed bump is disclosed that appears to operate by simply laying it across a road or lane of traffic. As seen in the drawings, this portable speed bump is an elongated bar that does not collapse or roll up for storage and transport. Therefore, this is a very cumbersome device in that a user must carry and store the portable speed bump in its elongated form.

Similarly, in U.S. Pat. No. DES 336,524 to White, et al. (the "White Patent "), a speed bump is shown that appears to be modular, however, it too is cumbersome during storage or transport. From the drawings it appears that the speed bump must be stored and transported as a plurality of modules because there is no means by which two adjacent modules are permanently joined. The drawing merely shows tabs on the end of one module being inserted into holes in the end of a second module. Therefore, there is no way to store or transport the speed bump in an assembled fashion. Also, this speed bump appears to be intended to be fixed to a highway surface in that the modules have a pair of tabs, and the ends of the speed bump have a tab, for securing the speed bump with a bolt, stake, or nail, to a highway surface.

Therefore, there remains a need for a portable speed bump that can be deployed and retracted by a single person.

In addition, there are no conventional or prior art speed bumps that incorporate any safety features, e.g., reflective materials and/or lights, or a controller for activating an alarm, counting vehicles, or heating the speed bump during inclement weather. Therefore, there is a need for a portable speed bump that contains one or more safety features and a controller.

SUMMARY OF THE INVENTION

The present invention solves the problems associated with conventional speed bumps by providing a portable speed bump (PSB) unit designed to be deployed and retracted by a single individual. The PSB unit comprises a plurality of speed bump cells removably and pivotally connected together to form a single PSB unit of variable length. Each speed bump cell comprises a plastic base having a rectangular footprint, a raised top surface, and a cross-sectional profile that is generally trapezoidal or semi-circular in shape. The speed bump cells are interconnected via one or more hinge bars that are pivotally connected together, thereby allowing two adjacent speed bump cells to be folded together such that an entire PSB unit can be rolled up for easy retrieval, portability, and storage purposes and simply unrolled to an extended position for deployment and use. During storage, the PSB unit of the present invention is housed in a storage container (e.g., a bag, box, metal cabinet, or plastic cabinet) in a rolled up position.

In operation, a PSB unit of the present invention is rolled up and stored in a storage container. A user deploys the PSB unit by unrolling or dragging the PSB unit across one or more lanes of traffic. Due to the uniform means for connecting PSB cells, two or more PSB units can be coupled together to form a larger PSB unit for convenience of deploying or storing. Therefore, a single PSB unit can be deployed independent of other PSB units, or, depending on the length of the area to be covered, two or more PSB units can be coupled together to form a larger unit of variable length.

In addition, if two PSB units are coupled together for storage purposes, then once at the deployment area, the two PSB units can either be used as a single larger PSB unit (as they were stored) or can be separated such that the two PSB units are used independent of each other. For example, one PSB unit is deployed across the lane of traffic closest to a pedestrian crossing point, while a second PSB unit is transported and deployed across the street to the opposite lane of traffic opposite the first unit deployed. Therefore, all lanes of traffic are covered. Alternatively, the two PSB units can be deployed in succession across the same lane of traffic resulting in a passing vehicle engaging two consecutive PSB units. Once coverage is no longer required, the two PSB units are brought back together and recoupled as a single larger PSB unit, then rolled back into the storage container.

A PSB unit can be designed and manufactured with the PSB cells of the unit having a specific slope and height. It is this combination of slope and height that achieves a desired effect with an oncoming vehicle. For example, if the PSB cells of a PSB unit have a steep slope and an increased height, then when a vehicle engages the PSB unit, it will have a large impact. In contrast, a slight slope and a decreased height will have minimal impact with a vehicle.

There are many advantages associated with the PSB unit of the present invention. A PSB unit of the present invention can be easily transported, deployed, retracted, and stored by a single person due to its ability to be rolled up and unrolled. A PSB unit can have a variable length, wherein a user can use any number of PSB cells as required for covering a traffic area. In the deployed position, a PSB unit is stable and substantially motionless as a vehicle rolls thereover. The PSB unit also retains greater strength and is less susceptible to breakage because it is so stable.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAIL DESCRIPTION OF THE PREFERRED EMBODIMENTS

Figure 1A:
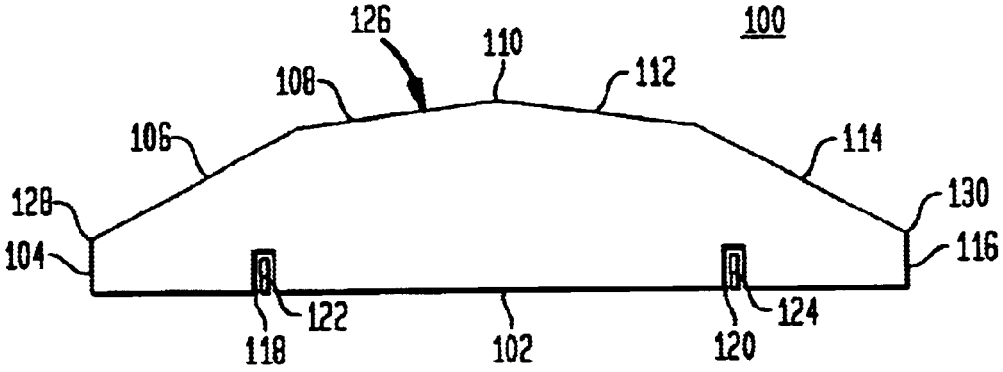
FIG. 1A is a cross sectional planar view of a portable speed bump cell of the present invention.
Figure 1B:
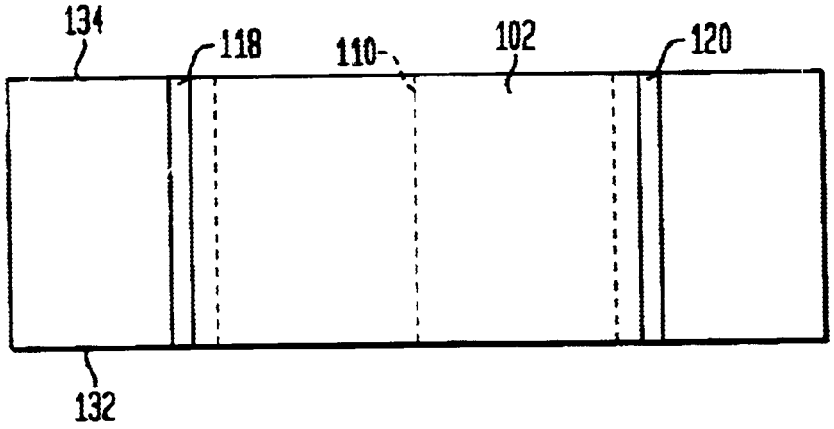
FIG. 1B is a planar bottom view of the portable speed bump cell.

FIG. 1A is a planar view of a cross-section of a portable speed bump (PSB) cell 100 of the present invention, and FIG. 1B is a planar bottom view of the PSB cell 100. In the preferred embodiment, the PSB cell 100 employs a rectangular footprint and has a general trapezoidal cross-section or end profile. Specifically, the PSB cell 100 is a block comprising a bottom 102, a first end 132, a second end 134, a front edge 128, a back edge 130, and a top surface 126, wherein the top surface 126 rises from the front edge 128, to a top point 110 above the bottom 102, and down to the back edge 130, and the first end 132 and the second end 134 are vertical planes extending from the top point 110 down to the bottom 102.

The cross section of the PSB cell 100 can be any shape from a curved, semi-circle (as in a conventional speed bump) to an angled shape. In the preferred embodiment, the top surface 126 of the PSB cell 100 comprises multiple straight edges: a first bottom edge 104, a first lower side 106, a first upper side 108, a second upper side 112, a second lower side 114, and a second bottom edge 116. The first bottom edge 104 and the second bottom edge 116 are vertical wherein all remaining sides (the first lower side 106, first upper side 108, second upper side 112, and second lower side 114) have an upwardly sloping angle terminating at a top point 110. In the preferred embodiment, the angle of the first lower side 106 and the second lower side 114 are equal and approximately 20–35 degrees, and the angle of the first upper side 108 and the second upper side 112 are also equal and approximately 5–20 degrees. Therefore, the angles of the first lower side 106 and the second lower side 114 are greater, or steeper, than the angles of the first upper side 108 and the second upper side 112. Due to the general shape of the PSB cell 100, the exterior top surface 126 is raised above the bottom 102 wherein the top point 110 is the furthest distance from the bottom 102.

The PSB cell 100 is described in these terms for convenience purpose only. In an alternative embodiment, the first bottom edge 104 and the second bottom edge 116 may be angled toward the center point 110 or may be omitted. Further, the first lower side 106, first upper side 108, second upper side 112, and second lower side 114 may have the same or different angled slopes. Furthermore, the PSB cells 100 of a PSB unit may comprise a plurality of straight angled sides, a single rounded surface, see FIGS. 5A, B, or a combination of a plurality of straight angled sides and one or more rounded surfaces, wherein the design of choice produces a specific desired effect. That is, sharp slopes in the top surface 126 will cause severe impact with a vehicle as compared to gradual slopes in the top surface 126 which will cause slight impact with a vehicle.

As described above, the first upper side 108 and the second upper side 112 intersect at a top point 110. In the preferred embodiment, the top point 110 is centrally located on the top surface of the PSB cell 100. In an alternative embodiment, however, if the first lower side 106, first upper side 108, second upper side 112, and second lower side 114 have different lengths and slopes, the top point 110 may be askew from the center of the top surface 126 in order to achieve a specific desired effect.

In the preferred embodiment, the PSB cells 100 of a PSB unit are interconnected by one or more hinge bars 202, 206. A PSB cell 100 has a first hinge support channel 118 and a second hinge support channel 120 that extend through the bottom 102 of the PSB cell 100 from the first end 132 to the second end 134. Further, a first hinge bar 122 is maintained in the first hinge support channel 118 and a second hinge bar 124 is maintained in the second hinge support channel 120. The means for maintaining the first hinge bar 122 and the second hinge bar 124 within their respective hinge support channels 118, 120 is well known in the relevant arts, e.g., by pins, clips, fasteners, adhesive, and the like.

In an alternative embodiment, the hinge support channels 118, 120 may be holes bored through a PSB cell 100 and not carved out channels. The use of bored holes would eliminate the need for a means for maintaining a hinge bar 122, 124 because the edges of the hole would maintain the hinge bar 122, 124 in proper place.

The hinge support channels 118, 120 and the hinge bars 122, 124 are used to connect two adjacent PSB cells 100, thereby creating a PSB unit comprising of a plurality of PSB cells 100. In the preferred embodiment, a plurality of PSB cells 100 are connected together as to create a PSB unit that is long enough to extend across one or more lanes of traffic.

Figure 2A:
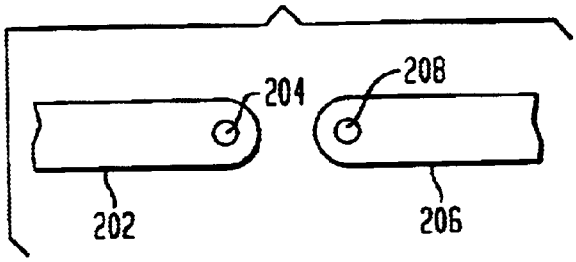
FIG. 2A is a planar side view of two consecutive hinge bars of the present invention.
Figure 2B:
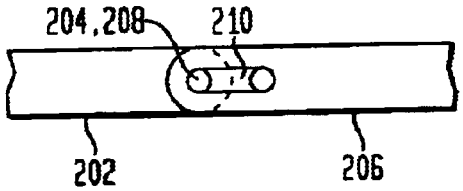
FIG. 2B is a planar side view of two interconnecting hinge bars.

FIG. 2A is a planar view of a first hinge bar 202 and a second hinge bar 206, and FIG. 2B is a planar view illustrating how the two hinge bars 202, 206 are connected, thereby joining two adjacent PSB cells 100. Each hinge bar 202, 206 has a female connector opening 204, 208, e.g. a hole, at each of its ends. To connect the two hinge bars 202, 206, the female connector opening 204 of the first hinge bar 202 is aligned with the female connector opening 208 of the second hinge bar 206, and a male connector pin 210 is inserted therein. The male connector pin 210 of the preferred embodiment is of such a size and dimension as to fit within the female connector openings 204, 208 and has a head of a larger dimension to prevent the male connector pin 210 from being pulled through the female connector openings 204, 208. Further, once the male connector pin 210 connects the two hinge bars 202, 206, the ends of the male connector pin 210 are clinched in a conventional manner to provide a permanent means of securing the two hinge bars 202, 206. By using female connector openings 204, 208 and a male connector pin 210, two adjacent PSB cells 100 are pivotally connected, thereby allowing each connected PSB cell 100 of a PSB unit to be pivotally rotated such that the PSB unit can be rolled up for storage and transport purposes, and can be easily unrolled for deployment.

The means for connecting two adjacent PSB cells 100 is described in these terms for convenience purpose only. It would be readily apparent to one of ordinary skill in the relevant art to use a comparable means for pivotally connecting two adjacent PSB cells 100, e.g., using a cotter or locking pin, a universal joint, male/female connectors, or a piano hinge with a connecting pin. All of these alternative means for connecting are well known in the relevant arts and are commercially available. Further, these different means of connecting may be made of plastic or metal.

In the preferred embodiment, a PSB cell 100 of the present invention is approximately 9 inches long, 4 inches wide, and 2 inches in height as measured from the bottom side 102 to the top point 110. The PSB cell 100 is made of a hard plastic and in the preferred embodiment it can be manufactured by conventional manufacturing methods of injection molding, vacuum molding, or pultrusion. The first and second hinge bars 122, 124 are preferably metal.

Figure 3A:
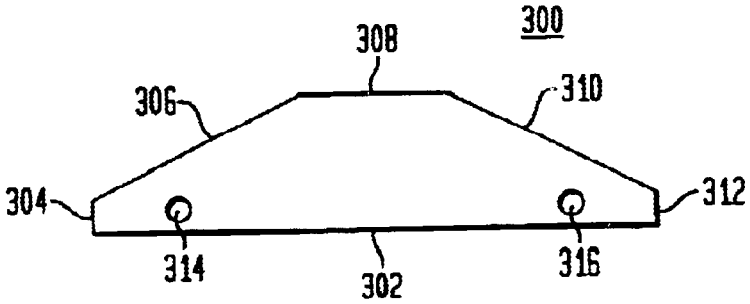
FIG. 3A is a cross sectional planar view of an alternative portable speed bump cell.
Figure 3B:
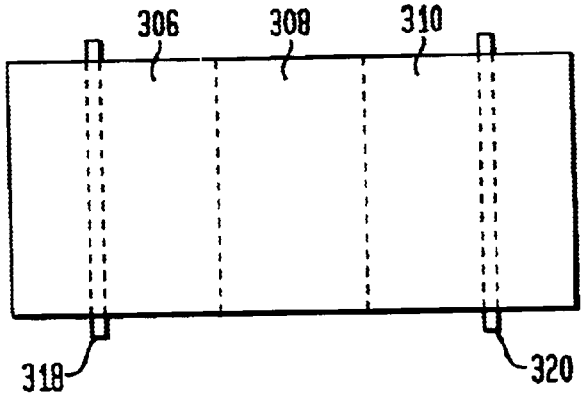
FIG. 3B is a planar top view of the alternative portable speed bump cell.

FIG. 3A is a planar view of the cross section of an alternative embodiment of a PSB cell 300, and FIG. 3B is a top view of the alternative PSB cell 300. In the alternative embodiment, the PSB cell 300 comprises a bottom 302, a first bottom edge 304, a first side 306 having an upwardly sloping angle, a top side 308, a second side 310 having an upwardly sloping angle, and a second bottom edge 312. In this embodiment, the top side 308 is centered on the PSB cell 300, but that is for convenience purpose only. It would be readily apparent to one of ordinary skill in the relevant arts to make the top side 308 askew to achieve a specific desired effect.

As with the first embodiment, the alternative PSB cell 300 also has a means for connecting two PSB cells 300. As shown in FIGS. 3A and 3B, two hinge support holes 314, 316 are drilled through the PSB cell 300 in which a hinge bar 318, 320 is inserted. The hinge bars 318, 320 operate as described above.

In this embodiment, a PSB cell 300 of the present invention is approximately 7 ¼ inches long, 6 ¾ inches wide, 3 inches in height and has a top side 308 of approximately 1 ¼ inches wide. Further, the preferred angle of slope of the first side 306 and the second side 310 is approximately 45 degrees; however, any comparable angle would suffice.

Figure 4:
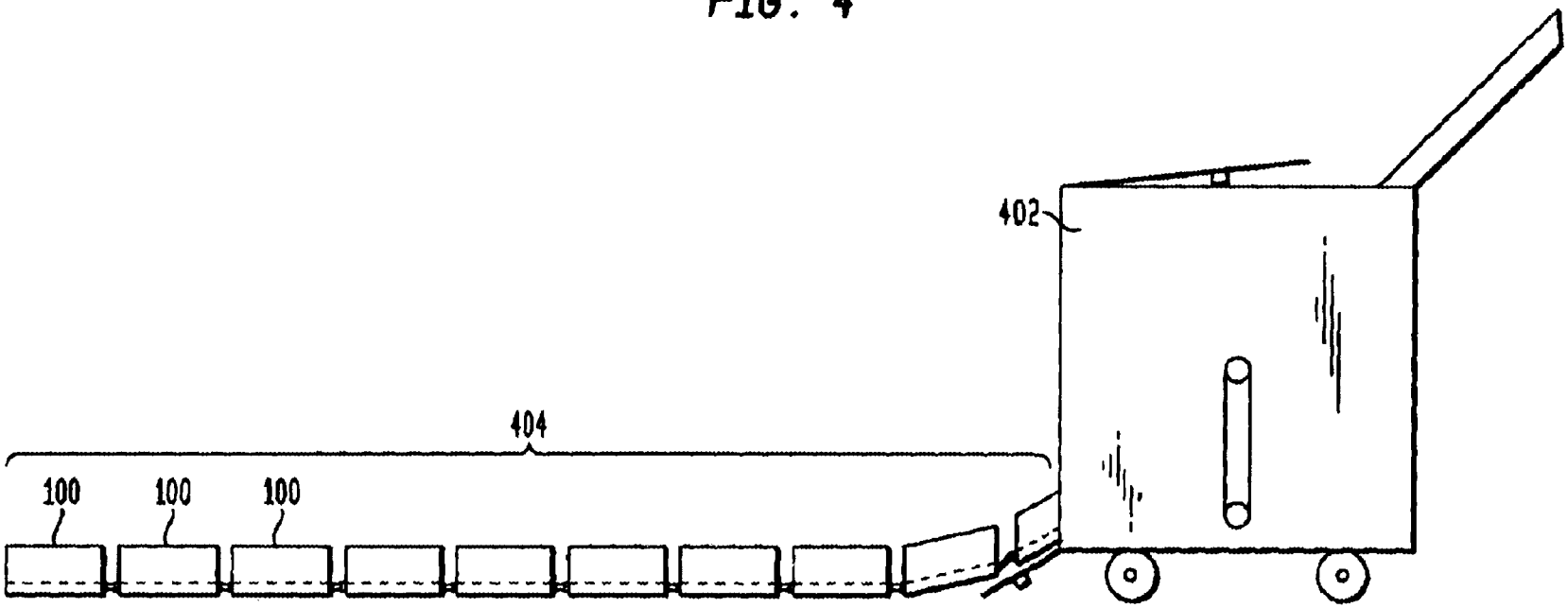
FIG. 4 is a planar side view of a portable speed bump unit and a storage container.

FIG. 4 is a planar view of a PSB unit 404 of the present invention, comprised of a plurality of adjacently and pivotally connected PSB cells 100, as being deployed/rolled up and stored in a storage container 402. During storage, the PSB unit 404 of the present invention is rolled around a conventional round cranking pulley system and stored within the storage container 402. In the preferred embodiment, the storage container 402 is a metal cabinet with wheels to facilitate transport and deployment. Such cranking pulley systems are well known in the relevant arts. It would be readily apparent to one of ordinary skill in the relevant arts to design and implement one with the PSB unit 404 of the present invention.

Figure 5A:
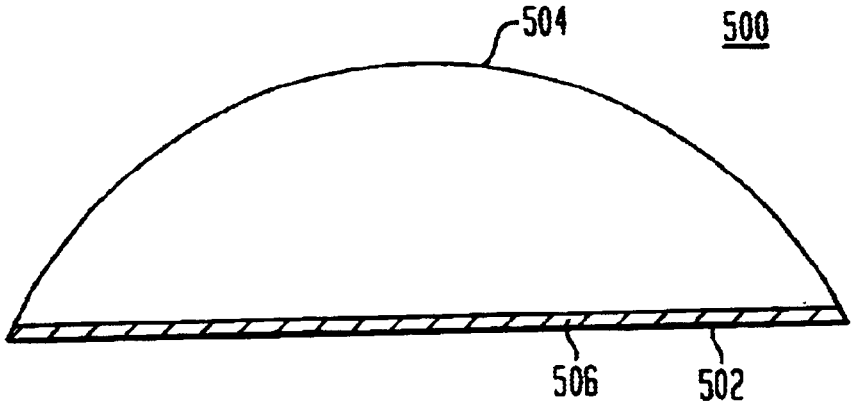
FIG. 5A is a cross sectional planar view of an alternative portable speed bump cell.

FIG. 5A is a planar view of the cross section of an alternative embodiment of a PSB cell 500. In the alternative embodiment, the PSB cell 500 is rounded in shape wherein the cross section of the PSB cell 500 is half a circle, oval, pointed oval, ellipse, or comparable rounded shape. The PSB cell 500 comprises a bottom 502 and a rounded top surface 504. Depending on the desired effect, the rounded top surface 504 of a PSB cell 500 can have any degree of slope, e.g., a steep slope or a gradual slope, and any height. It is the combination of slope and height of a rounded top surface 504 that creates a desired effect on traffic. As with the previously described embodiments, the alternative PSB cell 500 also has a means for connecting two PSB cells 500. As shown in FIG. 5A, the means for connecting two adjacent PSB cells 500 is a conventional piano hinge 506 with a connecting pin running the entire width of the PSB cells 500.

Figure 5B:
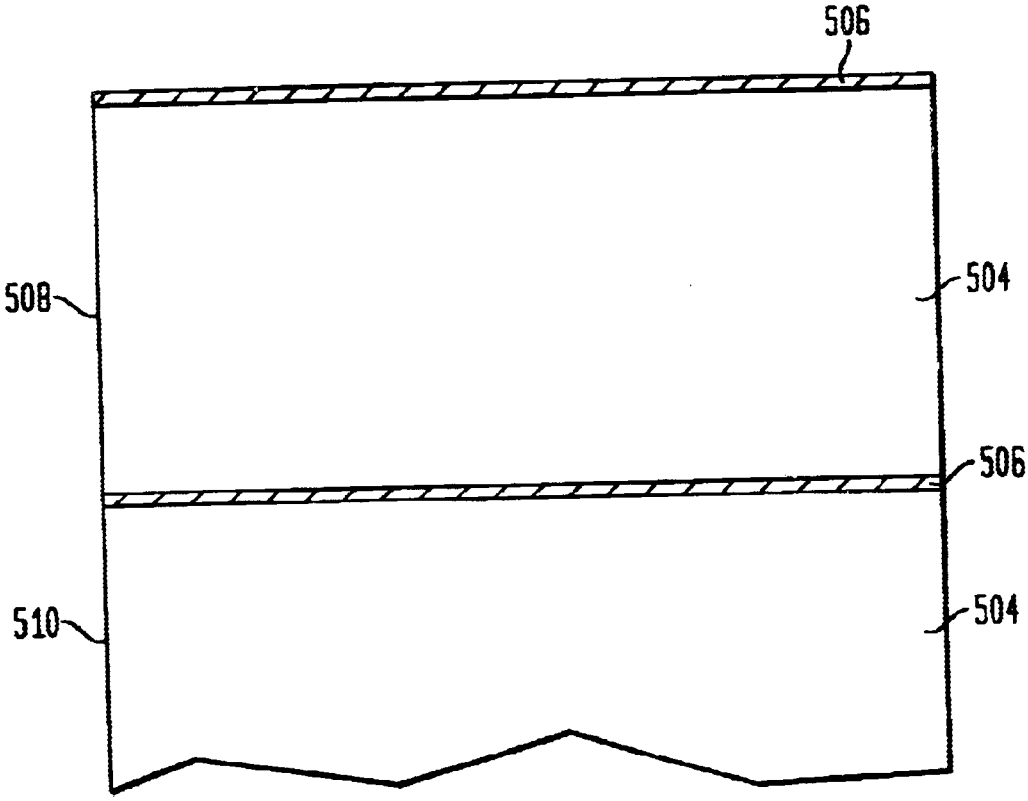
FIG. 5B is a planar top view of two interconnected alterative portable speed bump cell.

FIG. 5B is a planar top view of two adjacently and pivotally connected PSB cells 500. As shown, a first PSB cell 508 and a second PSB cell 510 are connected with a piano hinge 506. The use of piano hinges 506 between adjacent PSB cells 508, 510 provides the means by which the PSB cells 508, 510 rotate so that they can "roll up" for storage and transport.

Figure 6:
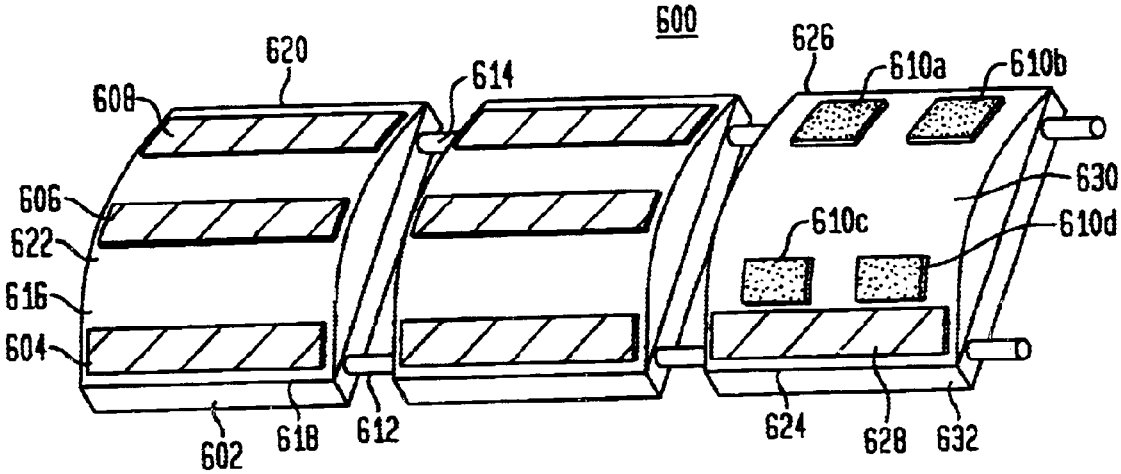
FIG. 6 is a perspective view of a portable speed bump unit with visual markings.

In alternative embodiments, the PSB cells 602 of a PSB unit 600 of the present invention may incorporate one or more safety features. For example, as shown in FIG. 6, reflective tape 604, 606, 608 or paint, or any light reflective material, can be applied to any visible portion of the top surface 616 of a PSB cell 602, e.g., near the front edge 618, back edge 620, or top point 622. The various safety features are described in terms of a single PSB cell 602, 632 for convenience purpose only. It would be readily apparent to one of ordinary skill in the relevant art to use the various safety features on a plurality of PSB cells 602, 632 connected via hinge bars 612, 614, thereby forming a PSB unit 600.

The use of a light reflective material enhances visibility of a PSB cell 602 and PSB unit 600, thereby causing traffic to slow down and minimize personal injury and damage to a vehicle. In the preferred embodiment for using light reflective material, conventional reflective tape 604, 606, and 608 is attached to the top surface 616 of a PSB cell 602 wherein the reflective tape 604, 606, and 608 has a reflective color or pattern on a top side and an adhesive on a bottom side. Such conventional reflective tape 604, 606, and 608 is commercially available. In addition, it would be readily apparent to one of ordinary skill in the art to apply paint or reflective material, e.g., reflective tape 604, 606, 608 on the top surface 616 of a PSB cell 632.

In addition to using light reflective material, one or more PSB cells 602 of a PSB unit 600 may be painted a reflective color, such as bright yellow because of yellow's high visibility, especially at night time. Although bright yellow is the preferred color, any other high visibility color would function equally as well, e.g., orange, lime or any neon color. In those situations when a PSB unit 600 of the present invention is to be used for covert operations, the preferred embodiment of the PSB unit is black or another dark color or pattern in order to minimize visibility of the PSB unit 600.

In yet other alternative embodiment, any number of other features can be embedded within or attached to a PSB cell 632 of a PSB unit 600 of the present invention, such as lights 610*a–d*. For example, different lights 610*a–d* may include: reflective lights, blinking lights or flashing strobe lights, all of which are commercially available. The lights 610*a* may be self contained wherein each light 610*a–d* contains its own power source or is attached to an internal power source. Furthermore, the lights 610*a–d* may incorporate a conventional photo-sensor so that the lights 610*a–d* only turn on at dusk or night. The preferred placement of lights 610*a–d* is along the front edge 624 or back edge 626 of the top surface 630 of a PSB cell 632. In addition, the use of lights 610*a–d* can be combined with reflective tape 628. It would be readily apparent to one of ordinary skill in the art to install one or more conventional lights 610*a–d* to a PSB cell 632.

Figure 7A:
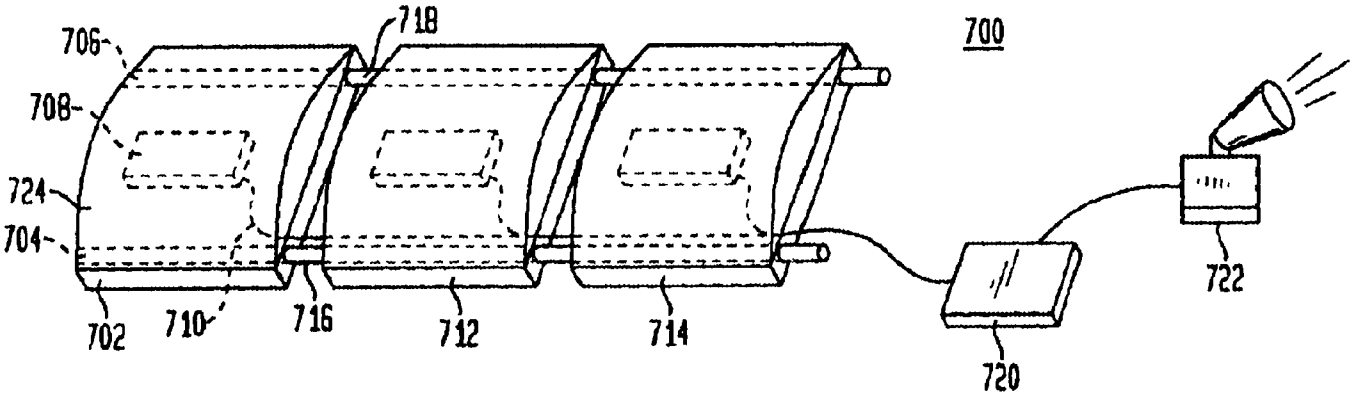
FIG. 7A is a perspective view of an alternative portable speed bump unit.

FIG. 7A is a perspective view of a PSB unit 700 showing a plurality of PSB cells 702, 712, 714 connected via hinge bars, e.g., hinge bars 716, 718. In this embodiment, each PSB cell, e.g., PSB cell 702, incorporates a controller 720 for activating: a means for counting vehicles that pass over the PSB unit 700, a means for activating an alarm 722 if a vehicle passes over the PSB unit 700, or a means for heating the PSB cells 702, 712, 714 so that ice and snow do not cover or interfere with the PSB unit 700. A means for counting is well known in the relevant art and is commercially available. It would be readily apparent to one of ordinary skill in the relevant art to incorporate such a means into the PSB unit 700 of the present invention. A means for counting may count the number of vehicles, or count vehicles of a specific weight. In this embodiment, a weight sensor 708 is embedded within each PSB cell 702. Therefore, when a vehicle passes over the PSB cell 702, the sensor 708 detects the vehicle and sends a signal back to a controller 720 which increments a vehicle counter. The sensor 708 is connected to the controller 720 via a wire 710 that runs parallel to the hinge bars 716, within one or more hinge support channels 704, 706 respectively, in order to traverse the length of the PSB unit 700 from the PSB cell 702 to the controller 720.

A means for activating an alarm 722, e.g, an audible alarm, is also well known in the relevant art and is commercially available. It would be readily apparent to one or ordinary skill in the relevant art to incorporate such a means into the PSB unit 700 of the present invention. In this embodiment, an alarm 722 is activated when any vehicle, or a vehicle of a specific weight, passes over one or more PSB cells 702, 712, 714 of the PSB unit 700. As described above, a sensor 708 is embedded within each PSB cell 702. Therefore, when a vehicle passes over the PSB cell 702, the sensor 708 detects the vehicle and sends a signal back to a controller 720 which sets off an alarm 722. The sensor 708 is connected to the controller 720 via a wire 710 that runs parallel to the hinge bars 716 in order to traverse the length of the PSB unit 700 from the PSB cell 702 to the controller 720.

Figure 7B:
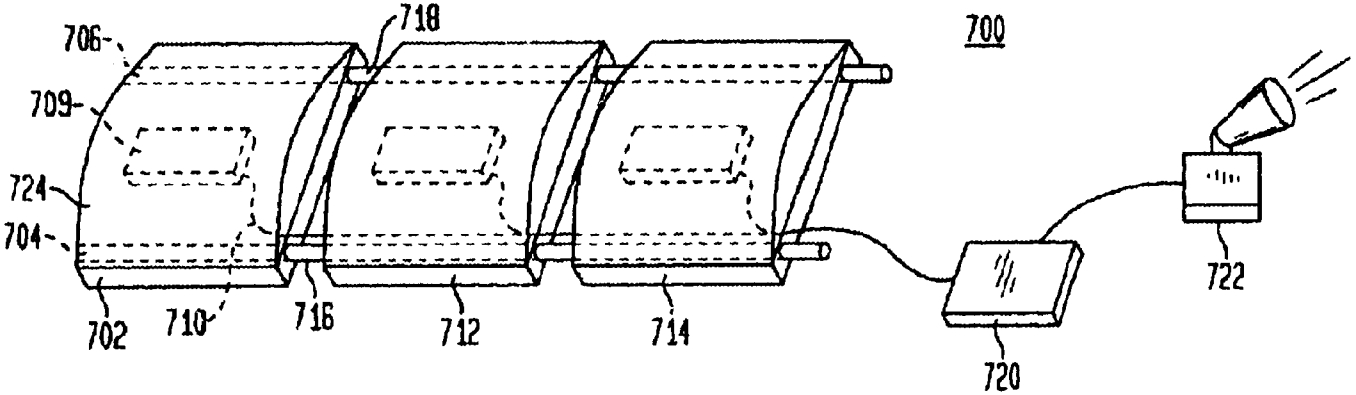
FIG. 7B is a perspective view of an alternative portable speed bump unit.

A means for heating the PSB cells 702 is also well known in the relevant art and is commercially available. It would be readily apparent to one of ordinary skill in the relevant art to incorporate such a means into the PSB unit 700 of the present invention as shown in FIG. 7B. In this embodiment, a heater 709 is embedded within each PSB cell 702 and is activated by a controller 720. Therefore, when activated, the controller 720 turns on the heater 709 to heat the PSB cell 702, thereby melting any snow or ice that may have accumulated on the top surface 724 of the PSB cell 702. The heater 709 is connected to the controller 720 via a wire 710 that runs parallel to the hinge bars 716 in order to traverse the length of the PSB unit 700 from the PSB cell 702 to the controller 720. By removing the snow and ice, visibility and safety are increased.

Figure 8:
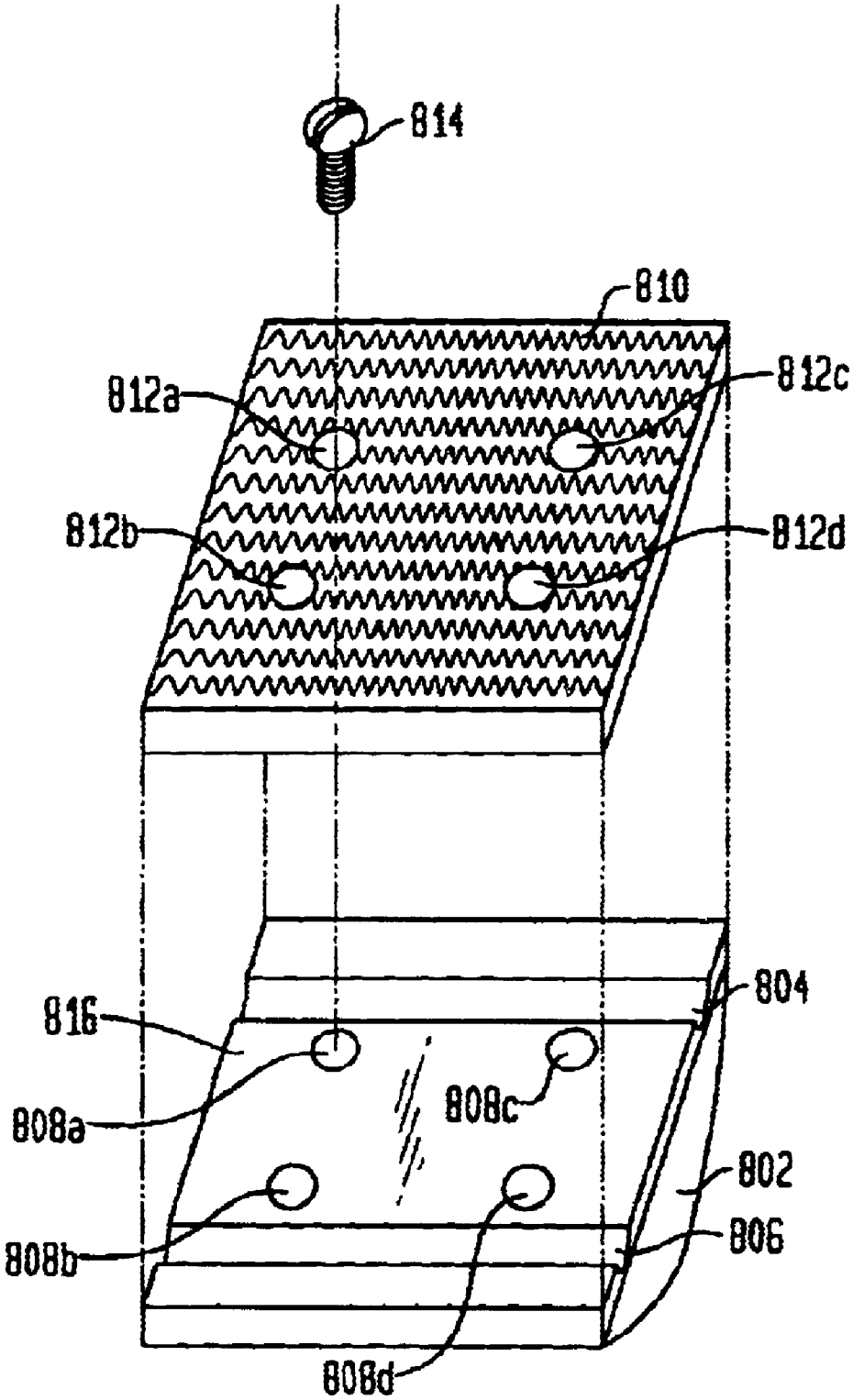
FIG. 8 is a perspective view of a portable speed bump cell having a bottom pad.

FIG. 8 is a perspective view of an inverted PSB cell 802 having a bottom pad 810 secured to its bottom side 816. In the preferred embodiment, the bottom pad 810 is made of a durable rubber which is textured, e.g., comprising a plurality of ridges, on its exterior surface that contacts the road. The bottom pad 810 provides the PSB cell 802 with better adhesion to a road surface, thereby eliminating or minimizing skidding of the PSB unit 802 as a vehicle passes over. In the preferred embodiment, the bottom pad 810 is secured to the bottom side 816 of the PSB cell 802 via a plurality of holes 812*a–d* in the bottom pad 810, a plurality of holes 808*a–d* in the bottom side 816 of the PSB cell 802, and a plurality of bolts 814 (only one of which is shown for convenience). In operation, the holes 812*a–d* of the bottom pad 810 align with the holes 808*a–d* in the bottom side 816 of the PSB cell 802, then one bolt 814 is inserted into one pair of aligned holes, e.g., aligned pair comprising hole 812*a* and hole 808*a*. The preferred embodiment is shown as using four (4) holes 812*a–d* in the bottom pad 810 and four (4) holes 808*a–d* in the PSB cell 802 for convenience purpose only. It would be readily apparent to one of ordinary skill in the relevant art to use a different number of holes to secure the bottom pad 810 to the bottom side 816 of a PSB cell 802.

Furthermore, the use of bolts 814 to secure the bottom pad 810 is also for convenience purpose only. It would be readily apparent to one of ordinary skill in the relevant art to use a comparable means for securing a bottom pad 810 to the bottom side 816 of a PSB cell 802, e.g., an adhesive, clip, or fastener. Alternatively, a bottom pad 810 of the present invention may be incorporated into the bottom side 816 of a PSB cell 802 such that the bottom pad 810 is an integral part of the bottom side 816. In any of these embodiments, the bottom pad 810 provides a means for maintaining a hinge bar 202 within a hinge support channel 804, 806 of the PSB cell 802.

All dimensions and components described herein are for convenience purposes only. It would be readily apparent for one of ordinary skill in the relevant arts to design and manufacture a portable speed bump cell or portable speed bump unit of the present invention having comparable features and dimensions, and manufactured using comparable materials. In addition, the details provided herein for designing and manufacturing a PSB cell, or any embodiment of a PSB cell, and the means for connecting two or more PSB cells to create a PSB unit is sufficient for one of ordinary skill in the relevant arts. Also, it would be readily apparent for one of such ordinary skill to design and manufacture a comparable PSB unit of the present invention

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention as defined in the specification and the appended claims. Thus, the breadth and scope of the present invention should not be limited by any of the above-described exemplary embodiments, but should be defined in accordance with the specification and any equivalents.

What is claimed is:

1. A portable speed bump unit for slowing a vehicle, comprising:

a plurality of speed bump cells, said speed bump cell being a block having a bottom and a top surface, said top surface starting at a front edge of said bottom, rising to a top point above said bottom, and filling to a back edge of said bottom; and a means for pivotally interconnecting said plurality of speed bump cells, such that each of said plurality of speed bump cells abuts a speed bump cell adjacent thereto thereby creating a longitudinal axis of the portable speed bump unit, and wherein said means for pivotally interconnecting is located between two adjacent speed bump cells and extends in a direction transverse to the longitudinal axis of the portable speed bump unit.

2. The portable speed bump unit according to claim 1, wherein each said speed bump cell has a cross section being generally trapezoidal in shape.

3. The portable speed bump unit according to claim 1, wherein each said speed bump cell has a cross section being generally rounded in shape.

4. The portable speed bump unit according to claim 1, wherein said top point is centrally located on said top surface of each said speed bump cell.

5. The portable speed bump unit according to claim 1, wherein said top point is askew from a centrally located point on said top surface of each said speed bump cell.

6. The portable speed bump unit according to claim 2, wherein each said speed bump cell comprises a first bottom edge, a first lower side, a first upper side, a second upper side, a second lower side, and a second bottom edge.

7. The portable speed bump unit according to claim 6, wherein said first lower side and said second lower side are equal in length and have the same angle of slope within the range of about 20 degrees to about 35 degrees.

8. The portable speed bump unit according to claim 6, wherein said first upper side and said second upper side are equal in length and have the same angle of slope within the range of about 5 degrees to about 20 degrees.

9. The portable speed bump unit according to claim 1, wherein one or more of said speed bump cells are a bright, reflective color.

10. The portable speed bump unit according to claim 1, wherein one or more of said speed bump cells are a dark, non-reflective color.

11. The portable speed bump unit according to claim 1, wherein one or more of said speed bump cells comprise one or more reflective markings.

12. The portable speed bump unit according to claim 1, wherein one or more of said speed bump cells comprise one or more lights.

13. The portable speed bump unit according to claim 12, wherein said one or more lights are blinking.

14. The portable speed bump unit according to claim 1, further comprising a means for counting vehicles.

15. The portable speed bump unit according to claim 1, further comprising a means for heating said plurality of speed bump cells.

16. The portable speed bump unit according to claim 1, further comprising a means for activating an alarm wherein said alarm is activated when the vehicle engages one or more of said speed bump cells.

17. The portable speed bump unit according to claim 16, wherein said alarm is an audible alarm.

18. The portable speed bump unit according to claim 16, wherein said alarm is a visual alarm.

19. The portable speed bump unit according to claim 1, wherein each said speed bump cell comprises a pad and a means for securing said pad to said bottom of said speed bump cell.

20. The portable speed bump unit according to claim 19, wherein said pad is a non-skid pad.

21. The portable speed bump unit according to claim 19, wherein said means for securing said pad to said bottom of said speed bump cell comprises said bottom of each said speed bump cell having one or more holes, said pad having one or more holes aligned with said holes in said bottom of said speed bump cell, and one or more bolts inserted into said holes of said pad and said holes in said bottom of said speed bump cell.

22. The portable speed bump unit according to claim 19, wherein said means for securing said pad to said bottom of said speed bump cell is selected from the group of an adhesive and one or more clips and fasteners.

23. The portable speed bump unit according to claim 1, wherein said means for pivotally interconnecting said plurality of speed bump cells comprises a plurality of piano hinges wherein one said piano hinge interconnects two adjacent speed bump cells.

24. The portable speed bump unit according to claim 12, wherein said lights incorporate one or more photo-sensors.

25. The portable speed bump unit according to claim 14, further comprising a controller and one or more weight sensors, wherein each said weight sensor is embedded into one said speed bump cell and sends a signal to said controller upon the detection of a vehicle passing over the portable speed bump unit, said controller counts and displays the number of signals received from said weight sensors.

26. The portable speed bump unit according to claim 15, further comprising a controller and one or more heaters, wherein each said heater is embedded into one said speed bump cell, said controller activating and deactivating said heaters.

27. The portable speed bump unit according to claim 16, further comprising a controller and one or more means for detecting a vehicle, wherein each means for detecting a vehicle is incorporated into one said speed bump cell and sends a signal to said controller upon the detection of a vehicle, said controller activates said alarm upon receipt of said signal.

28. The portable speed bump unit according to claim 27, wherein said means for detecting a vehicle is a weight sensor.

29. The portable speed bump unit according to claim 27, wherein said means for detecting a vehicle is a motion detector.

30. The portable speed bump unit according to claim 1, wherein each said block is substantially solid.

31. The portable speed bump unit according to claim 1, wherein said means for pivotally interconnecting said plurality of speed bump cells is selected from the group consisting of a locking pin, a universal joint, male/female connectors, and a piano hinge.

* * * * *

US006623206C1

(12) EX PARTE REEXAMINATION CERTIFICATE (9943rd)

United States Patent
Blair et al.

(10) Number: US 6,623,206 C1
(45) Certificate Issued: Nov. 15, 2013

(54) PORTABLE SPEED BUMP

(75) Inventors: William H. Blair, Wheeling, WV (US); David R. Blair, Triadelphia, WV (US); Robert E. Steele, Wheeling, WV (US)

(73) Assignees: William H. Blair, Wheeling, WV (US); Marianne B. Blair, Wheeling, WV (US)

Reexamination Request:
No. 90/012,092, Jan. 12, 2012

Reexamination Certificate for:

| | |
|---|---|
| Patent No.: | **6,623,206** |
| Issued: | **Sep. 23, 2003** |
| Appl. No.: | **09/545,017** |
| Filed: | **Apr. 7, 2000** |

Related U.S. Application Data

(60) Provisional application No. 60/128,068, filed on Apr. 7, 1999.

(51) Int. Cl.
*E01F 9/047* (2006.01)
*E01F 9/04* (2006.01)

(52) U.S. Cl.
USPC ..... 404/16; 404/15; 404/12

(58) Field of Classification Search
None
See application file for complete search history.

(56) References Cited

To view the complete listing of prior art documents cited during the proceeding for Reexamination Control Number 90/012,092, please refer to the USPTO's public Patent Application Information Retrieval (PAIR) system under the Display References tab.

*Primary Examiner* — Aaron J. Lewis

(57) ABSTRACT

A portable speed bump unit having a plurality of speed bump cells removably and pivotally connected together to form a single PSB unit of variable length. Each speed bump cell comprises a plastic base having a rectangular footprint, a raised top surface, and a cross-sectional profile that is generally trapezoidal or semi-circular in shape. The speed bump cells are interconnected via one or more hinge bars that are pivotally connected together, thereby allowing two adjacent speed bump cells to be folded together such that an entire PSB unit can be rolled up for easy retrieval, portability, and storage purposes and simply unrolled to an extended position for deployment and use. Alternative embodiments of a portable speed bump unit incorporate safety features, e.g., reflective materials and/or lights, into one or more portable speed bump cells, or a controller into one or more portable speed bump cells for controlling a means for counting vehicles, a means for activating an alarm, or a means for heating the portable speed bump cells.

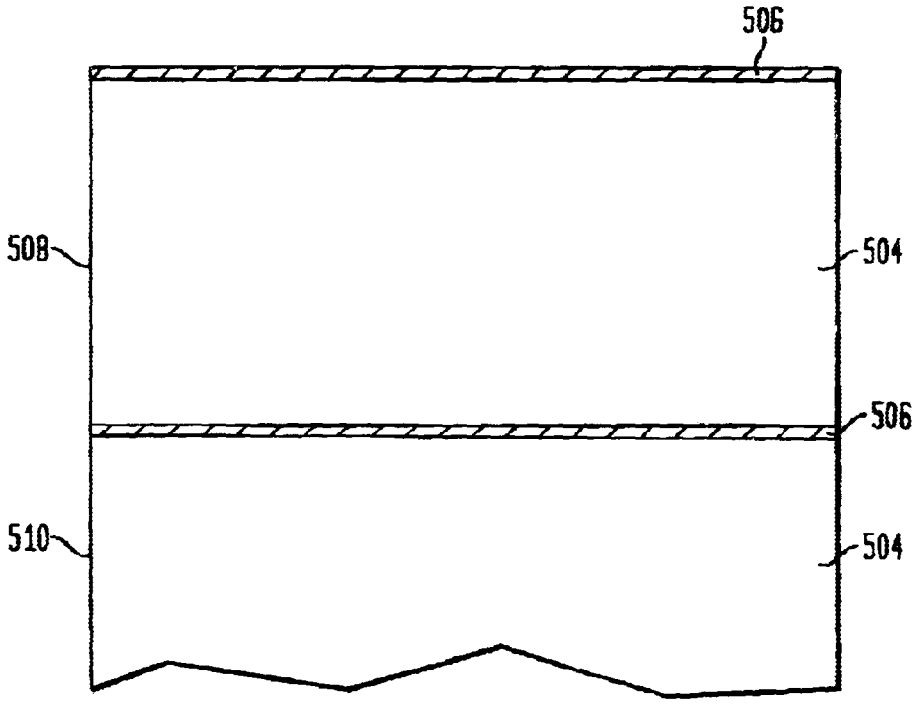

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-5, 9-11, 19, 23 and 30 are determined to be patentable as amended.

Claims 6-8, 12-18, 20-22, 24-29 and 31, dependent on an amended claim, are determined to be patentable.

1. A portable speed bump unit for slowing a vehicle, comprising:

a plurality of speed bump cells, *each* said speed bump cell being a block having a bottom and a top surface, said top surface starting at a front edge of said bottom, rising to a top point above said bottom, and [filling] *falling* to a back edge of said bottom; and a means for pivotally interconnecting said plurality of speed bump cells, such that each of said plurality of speed bump cells abuts a speed bump cell adjacent thereto thereby creating a longitudinal axis of the portable speed bump unit, and wherein said means for pivotally interconnecting is located between two adjacent speed bump cells and extends in a direction transverse to the longitudinal axis of the portable speed bump unit.

2. The portable speed bump unit according to claim [1] *23*, wherein each said speed bump cell has a cross section being generally trapezoidal in shape.

3. The portable speed bump unit according to claim [1] *23*, wherein each said speed bump cell has a cross section being generally rounded in shape.

4. The portable speed bump unit according to claim [1] *23*, wherein said top point is centrally located on said top surface of each said speed bump cell.

5. The portable speed bump unit according to claim [1] *23*, wherein said top point is askew from a centrally located point on said top surface of each said speed bump cell.

9. The portable speed bump unit according to claim [1] *23*, wherein one or more of said speed bump cells are a bright, reflective color.

10. The portable speed bump unit according to claim [1] *23*, wherein one or more of said speed bump cells are a dark, non-reflective color.

11. The portable speed bump unit according to claim [1] *23*, wherein one or more of said speed bump cells comprise one or more reflective markings.

19. The portable speed bump unit according to claim [1] *23*, wherein each said speed bump cell comprises a pad and a means for securing said pad to said bottom of said speed bump cell.

23. [The portable speed bump unit according to claim 1,] *A portable speed bump unit for slowing a vehicle, comprising:*

*a plurality of speed bump cells, each said speed bump cell being a block having a bottom and a top surface, said top surface starting at a front edge of said bottom, rising to a top point above said bottom, and falling to a back edge of said bottom; and*

*a means for pivotally interconnecting said plurality of speed bump cells, such that each of said plurality of speed bump cells abuts a speed bump cell adjacent thereto thereby creating a longitudinal axis of the portable speed bump unit, and wherein said means for pivotally interconnecting is located between two adjacent speed bump cells and extends in a direction transverse to the longitudinal axis of the portable speed bump unit;* wherein said means for pivotally interconnecting said plurality of speed bump cells comprises a plurality of piano hinges wherein one said piano hinge interconnects two adjacent speed bump cells.

30. The portable speed bump unit according to claim [1] *23*, wherein each said block is substantially solid.

* * * * *